US012070118B1

(12) United States Patent
Amoroso et al.

(10) Patent No.: US 12,070,118 B1
(45) **Date of Patent: *Aug. 27, 2024**

(54) EXTENDABLE AND RETRACTABLE COUPLING SYSTEM

(71) Applicants: Michele Amoroso, Charlotte, NC (US); John H. Phares, Jr., Charlotte, NC (US)

(72) Inventors: Michele Amoroso, Charlotte, NC (US); John H. Phares, Jr., Charlotte, NC (US)

(73) Assignee: MEA VENTURES LLC, Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/144,218

(22) Filed: May 7, 2023

Related U.S. Application Data

(63) Continuation of application No. 17/860,572, filed on Jul. 8, 2022, now Pat. No. 11,641,931, which is a continuation of application No. 17/152,370, filed on Jan. 19, 2021, now Pat. No. 11,412,838.

(60) Provisional application No. 62/962,410, filed on Jan. 17, 2020.

(51) Int. Cl.
*A45F 5/00* (2006.01)
*A45F 5/02* (2006.01)

(52) U.S. Cl.
CPC ..... *A45F 5/004* (2013.01); *A45F 5/021* (2013.01); *A45F 2200/0516* (2013.01)

(58) Field of Classification Search
CPC ..... A45F 5/004; A45F 5/021
USPC ..... 224/269, 162
See application file for complete search history.

(56) References Cited

U.S. PATENT DOCUMENTS

| | | | | |
|---|---|---|---|---|
| 7,007,882 | B2 * | 3/2006 | Raia | A45F 5/004 242/380 |
| 7,380,357 | B2 * | 6/2008 | Jones | G09F 3/207 40/586 |
| 7,661,620 | B2 * | 2/2010 | Fields | A45F 5/004 224/217 |
| 7,762,215 | B2 * | 7/2010 | Horton | A45F 5/004 242/379.2 |
| 8,220,676 | B1 * | 7/2012 | Hicks | B65H 75/48 242/379 |

(Continued)

FOREIGN PATENT DOCUMENTS

WO WO-2019126679 A1 * 6/2019 ..... A45C 13/02

*Primary Examiner* — Nathan J Newhouse
*Assistant Examiner* — Lester L Vanterpool
(74) *Attorney, Agent, or Firm* — Invention To Patent Services; Alex Hobson

(57) ABSTRACT

An extendable and retractable coupling system is configured with a retractable coupler that is tethered to a coupler body to retain valuable item to a person or other item. An extendable coupling system has a dual coupler having a fixed coupler that is stationary, or configured on the coupler body and a retractable coupler that is coupled to the coupler body by a tether. The retractable coupler may be coupled to a valuable item, such as a mobile phone and the fixed coupler may be coupled to a person clothing, such as to a belt loop, for example. The user may then extend the tether to use their mobile phone and place the phone back into a pocket when not in use. The tether may prevent the valuable item, such as the mobile phone, from dropping to the ground and being damaged.

17 Claims, 5 Drawing Sheets

(56) References Cited

U.S. PATENT DOCUMENTS

| | | | | |
|---|---|---|---|---|
| 9,060,588 | B2 * | 6/2015 | Bransfield | A45F 5/02 |
| 9,629,447 | B1 * | 4/2017 | Martel | A45C 11/00 |
| 9,717,323 | B2 * | 8/2017 | Tsai | F16B 2/20 |
| 10,016,009 | B1 * | 7/2018 | Bacchus | A42B 7/00 |
| 10,730,718 | B2 * | 8/2020 | Castañeda | A45F 5/004 |
| D903,475 | S * | 12/2020 | Rodriguez | D8/356 |
| D920,320 | S * | 5/2021 | Huang | D14/253 |
| 11,026,502 | B1 * | 6/2021 | Erold | A45F 5/004 |
| 2006/0090302 | A1 * | 5/2006 | Colby | A45F 5/004 24/3.6 |
| 2007/0023557 | A1 * | 2/2007 | Rankin, VI | A45F 5/004 242/381 |
| 2007/0213104 | A1 * | 9/2007 | Fields | A45F 5/004 455/128 |
| 2009/0242595 | A1 * | 10/2009 | Gross | A45F 5/004 224/162 |
| 2014/0216209 | A1 * | 8/2014 | Shrock | B67B 7/16 81/3.25 |
| 2015/0157116 | A1 * | 6/2015 | Williams | A45F 5/02 224/269 |
| 2020/0154869 | A1 * | 5/2020 | Jenkins | A45F 5/004 |

* cited by examiner

EXTENDABLE AND RETRACTABLE COUPLING SYSTEM

CROSS REFERENCE TO RELATED APPLICATIONS

This application is a continuation of U.S. patent application Ser. No. 17/860,572, filed on Jul. 8, 2022 and currently pending, which is a continuation of U.S. patent application Ser. No. 17/152,370, filed on Jan. 19, 2021 and issued on Aug. 16, 2022 as U.S. Pat. No. 11,412,838, which claims the benefit of priority to U.S. provisional patent application No. 62/962,410, filed on Jan. 17, 2020; the entirety of which is hereby incorporated by reference herein.

BACKGROUND OF THE INVENTION

Field of the Invention

The invention relates to an extendable and retractable coupling system to attach a valuable item to avoid dropping, loss or theft of said item. A mobile device, and other valuable items, such as keys or wallet, may be tethered to a garment or a user's personal property via attachment to a belt loop, interior pockets, or baggage.

Background

Today, people are burdened by the requirement to carry with them many various items such as cell phones, wallets, keys, personal protection devices, access cards and the like. Carrying a plurality of products in pockets can be uncomfortable and they can sometimes slip out unnoticed, such as when seated. Carrying a large number of items in a purse can make it difficult to find a desired item and the jostling of the items in the purse can lead to damage, such as scratches on a lens for example. In addition, sports enthusiasts such as bikers, runners, hikers, mountain climbers and the like, often want to carry mobile devices, such as mobile phones, with them to take pictures and to contact people in case of emergency. Carrying these devices while engaged in recreation activities can result in damage or loss of the device if it is not properly retained.

SUMMARY OF THE INVENTION

The invention is directed to an extendable and retractable coupling system configured with a retractable coupler that is tethered to a coupler body to retain a valuable item to a person or other item. An exemplary extendable and retractable coupling system, herein referred to as an extendable coupling system prevents the loss, drop, damage or theft of a valuable item such as a mobile electronic device including a mobile phone. An exemplary extendable coupling system enables a person to anchor a valuable item to them, such as to their clothing, belt, bag, and the like and utilize the valuable item by extending from a coupled location by a tether.

An exemplary extendable and retractable coupling system comprises a dual coupler having a fixed coupler that is stationary, or configured on the coupler body, and a retractable coupler that is coupled to the coupler body by a tether. The retractable coupler may be coupled to a valuable item, such as a mobile phone and the fixed coupler may be coupled to a person's clothing, such as to a belt loop, for example. The user may then extend the tether to use their mobile phone and place the phone back into a pocket when not in use. The tether may prevent the valuable item, such as the mobile phone, from dropping to the ground and being damaged as the tether length will limit how far the phone can extend from the coupler body.

An exemplary dual coupler has a coupler body that is configured for ease of use and may have a shape that prevents the coupler body from snagging on clothing. An exemplary coupler body may have a smooth continuous outer perimeter, wherein the outer perimeter is a continuous curved surface; having no sharp corners and substantially no gaps, or no gap of more than 8 mm in width, preferably no more than 5 mm and even more preferably no more than 2 mm in width. An exemplary coupler body with substantially no gaps will have a small gap in the continuous curved surface between the retractable coupler where it forms part of the coupler continuous outer perimeter when in a retracted position. Also, the coupler may be compact having a relatively short length and narrow width, such as no more than about 125 mm, no more than 100 mm, no more than 75 mm or no more than 50 mm and any range between and including the length and/or width values provided. The thickness of the coupler body may be no more than about 75 mm, no more than about 50 mm, no more than about 25 mm and any range between and including the thickness values provided.

An exemplary dual coupler has a fixed coupler on one end and a retractable coupler on an opposing second end. The fixed coupler may comprise a body coupler latch that pivots inward into a body coupler aperture, thereby preventing the latch from snagging on clothing during use. A retractable coupler may have a retractable coupler body that is configured to be retained in a receptor recess of the coupler body. A portion of the outer perimeter of the retractable coupler may form a portion of the outer perimeter of the dual coupler body when in a retracted orientation. Again, the outer perimeter of the coupler body, including the portion formed by the retractable coupler may be smooth and continuous to prevent snagging on clothing. The gap between the retractable coupler and the outer perimeter of the coupler body may be less than about 4 mm, or no more than about 3 mm, or no more than about 2 mm to produce a smooth and continuous outer perimeter. An exemplary retractable coupler may comprise a centering feature that will configure or align the retractable coupler with the receptor recess upon retraction. A tapered portion of the tethered end of the retractable coupler may act as a centering feature. An exemplary retractable coupler comprises a latch which may be configured to pivot inward into a retractable coupler aperture. This inward pivoting latch may prevent the latch from snagging on clothing.

An exemplary retractable coupler is coupled to the coupler body by a tether that extends from a spring-loaded tether device. An exemplary spring-loaded tether device may comprise a torsional spring that pulls the tether around a spool to retract the tether. The spring-loaded tether device and in particular the spool for the tether may be located within the outer perimeter of the coupler body. The spring loaded tether device may have a stop and release button to allow the tether to remain in a hold state. The force produced by the spring on the tether may be about 0.25 Newton (N) or more, about 0.5N or more, about 0.75N or more, about 1N or more, about 1.52N or more and any range between and including the force values provided.

An exemplary extendable and retractable coupling system may further include a mobile device attachment configured to couple with a mobile device and have an attachment for coupling with the retractable coupler. In an exemplary embodiment, a mobile device attachment has corner extensions and corner apertures to enable the corner extensions to extend over the corners of mobile device and in particular a mobile phone. An exemplary mobile device attachment may have an attachment tab that extends to an attachment loop for coupling with the retractable latch. An exemplary mobile device attachment may also be configured to fit between a mobile device, such as a phone, and a cover and have a tab that extends out from the cover, such as through an aperture in the cover; a charging portal, for example. Again, the tab may extend to an attachment loop.

The summary of the invention is provided as a general introduction to some of the embodiments of the invention, and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

Figure 1:
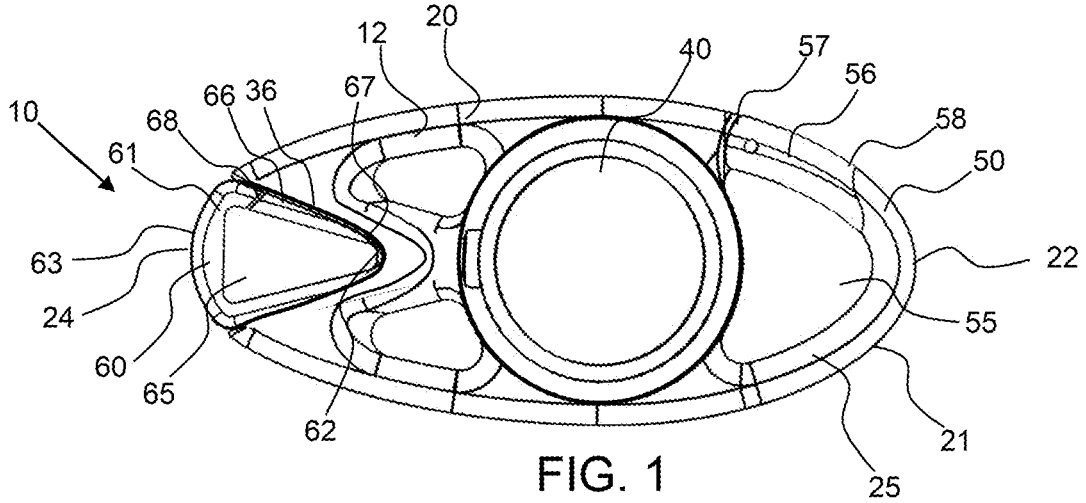
FIG. 1 shows a top view of an exemplary dual coupler of an extendable coupling system having a body coupler and retractable coupler, wherein the retractable coupler is extendable from the coupler body.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

DETAILED DESCRIPTION OF THE ILLUSTRATED EMBODIMENTS

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

Figure 2:
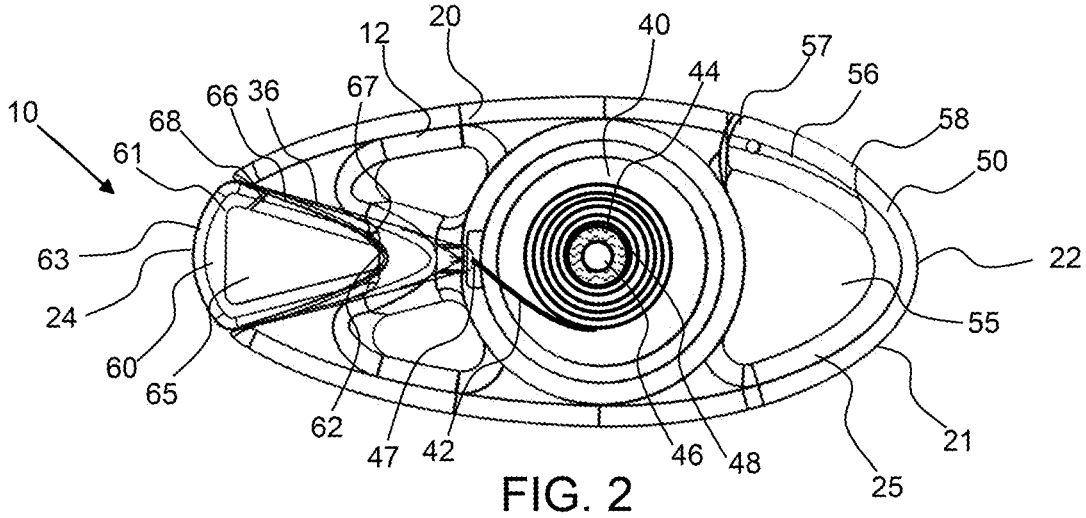
FIG. 2 shows a cut-away view of an exemplary dual coupler having receptor recess to dock the retractable coupler, wherein the retractable coupler is attached to a tether that is retained in the spring-loaded tether device.

Referring now to FIGS. 1 and 2, an exemplary dual coupler 12 of an extendable coupling system 10 has a stationary body coupler 50 and a retractable coupler 60 having a retractable coupler body 61, wherein the retractable coupler is extendable from the coupler body 20 by a tether 42. The coupler body has a length from the first end 22 to the second end 24. The body coupler is configured on the first end 22 of the coupler body and comprises a body coupler latch 56 that has an extended end 58 that rotates into a body coupler aperture 55 of the coupler body 20. The body coupler latch rotates about a pivot on a pivot end 57. The retractable coupler 60 is configured on the second end 24 of the coupler body and comprises a retractable coupler latch 66 that has an extended end 68 that rotates into a retractable coupler aperture 65. The retractable coupler latch rotates about a pivot end 67. The retractable coupler extends away from the coupler body 20 and has an extended end 63 and a tethered end 62. The retractable coupler is drawn back into a receptor recess 36 in the coupler body 20 and when in a stowed configuration, as shown in FIGS. 1 and 2, the outer perimeter 21 of the coupler body is smooth and continuous, as defined herein. This smooth and continuous outer perimeter prevents the dual coupler from getting snagged on clothing during use.

The retractable coupler is extended from and retracted back by a spring loaded tether device 40 having a spring 44, that retracts the tether 42 around a spool 46. The spring may be a torsional spring. The tether has a retained end 48, which may be retained to the spool and a coupler end 47 which is coupled to the tether end 62 of the retractable coupler 60.

Figure 3:
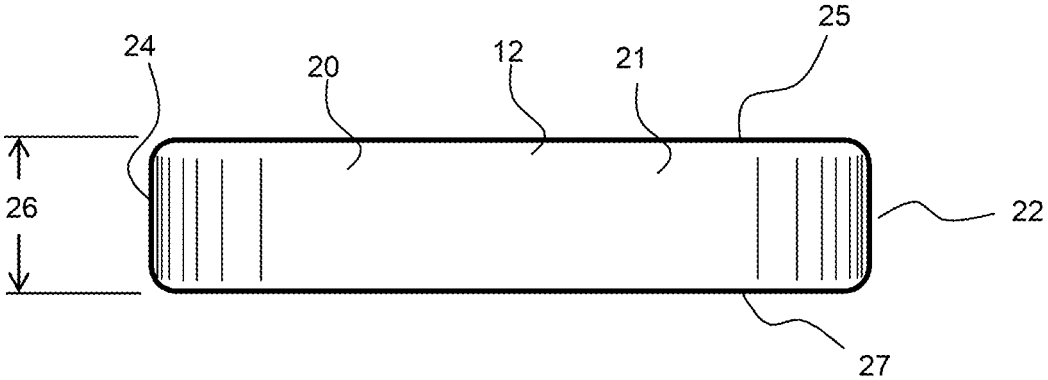
FIG. 3 shows a side view of an exemplary dual coupler of an extendable coupling system, wherein the outer perimeter of the dual coupler body is a continuous outer perimeter as defined herein.

As shown in FIG. 3, the coupler body 20 of the dual coupler 12 has a planar top surface 25 and bottom surface 27. The edges of the coupler body may be smooth having no sharp angles and may have curved surfaces. The thickness of the coupler body 26 may be kept relatively low for ease of use when retained in the pocket of a garment, for example. The coupler body is substantially planar wherein the top and bottom surfaces are substantially parallel and offset by a coupler body thickness.

Figure 4:
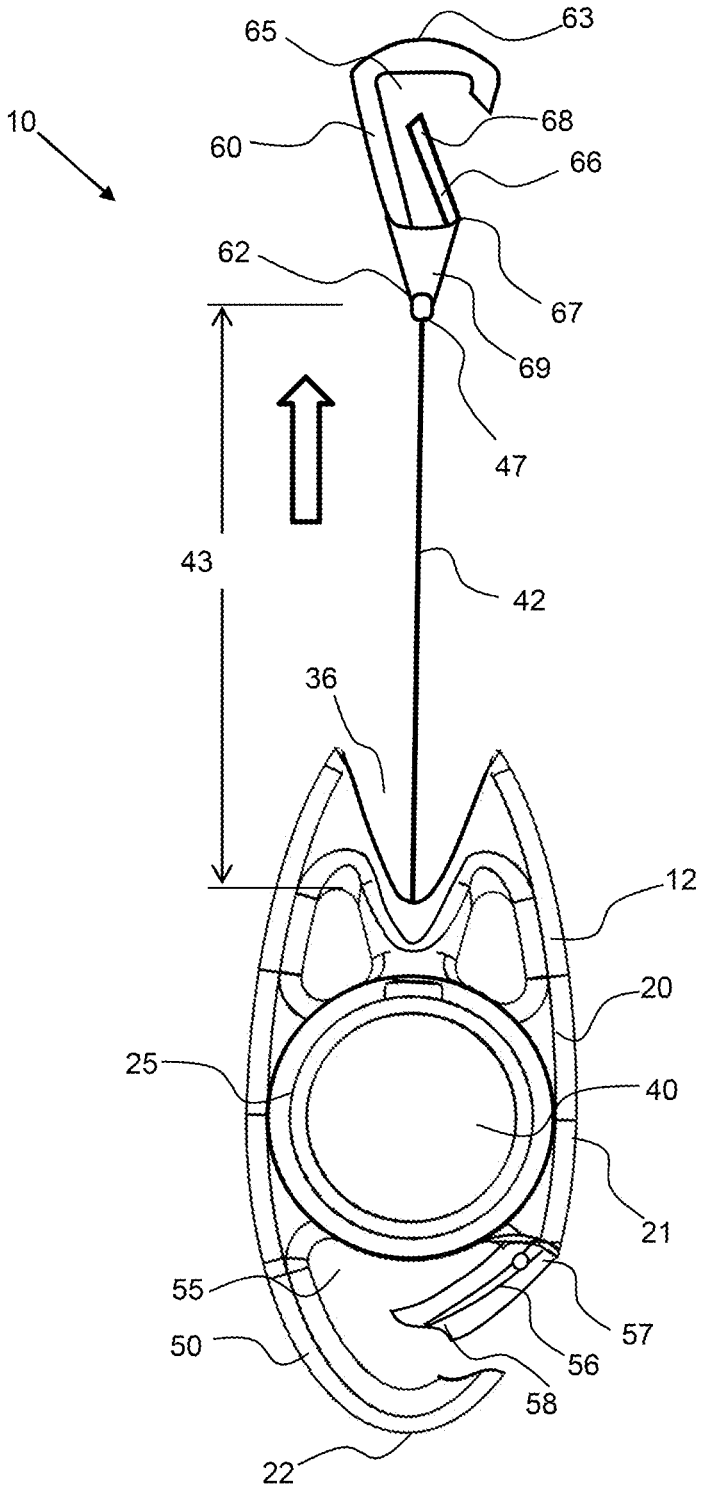
FIG. 4 show a top view of an exemplary dual coupler of an extendable coupling system, having the retractable coupler extended from the dual coupler body and both the body coupler latch and retractable coupler latch in an open configuration.

As shown in FIG. 4, exemplary dual coupler 12 of an extendable coupling system 10 has the retractable coupler 60 extended from the dual coupler body 20 and both the body coupler latch 56 and retractable coupler latch 66 are in an open configuration. The tether 42 has a tether length 43 as described herein. The receptor recess 36 is tapered from a larger opening at the outer perimeter 21 toward the spring loaded tether device 40. Likewise, the retractable coupler 60 is tapered toward the tether end 62 and has a centering feature 69 that has a geometric shape to fit within a receiver in the receptor recess, proximal to the spring loaded tether device 40.

Figure 5:
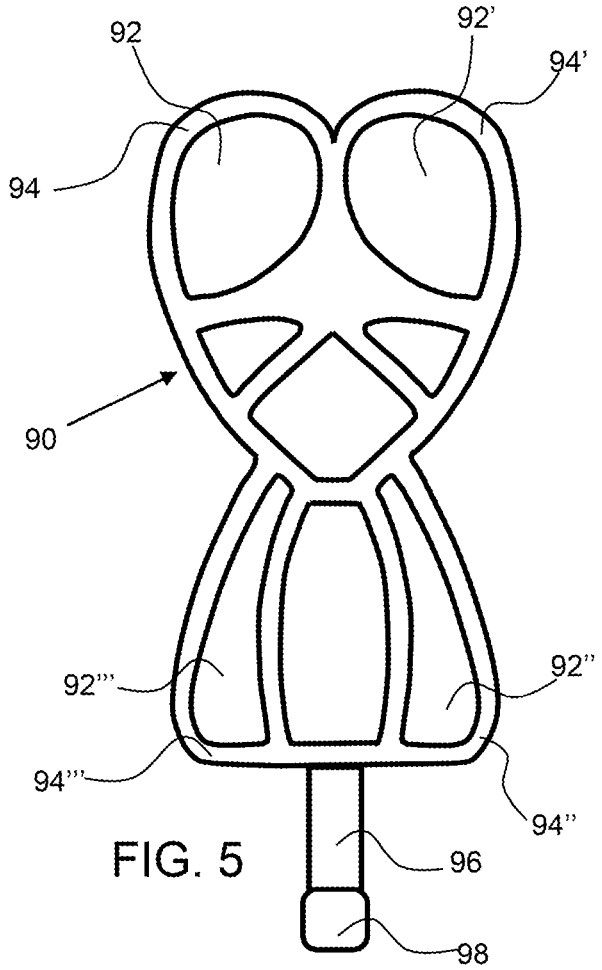
FIG. 5 and FIG. 6 shows a top view of an exemplary mobile device attachment having corner extension for extending over the corners of a mobile device, and an attachment tab having an attachment loop on the extended end of the attachment belt.
Figure 6:
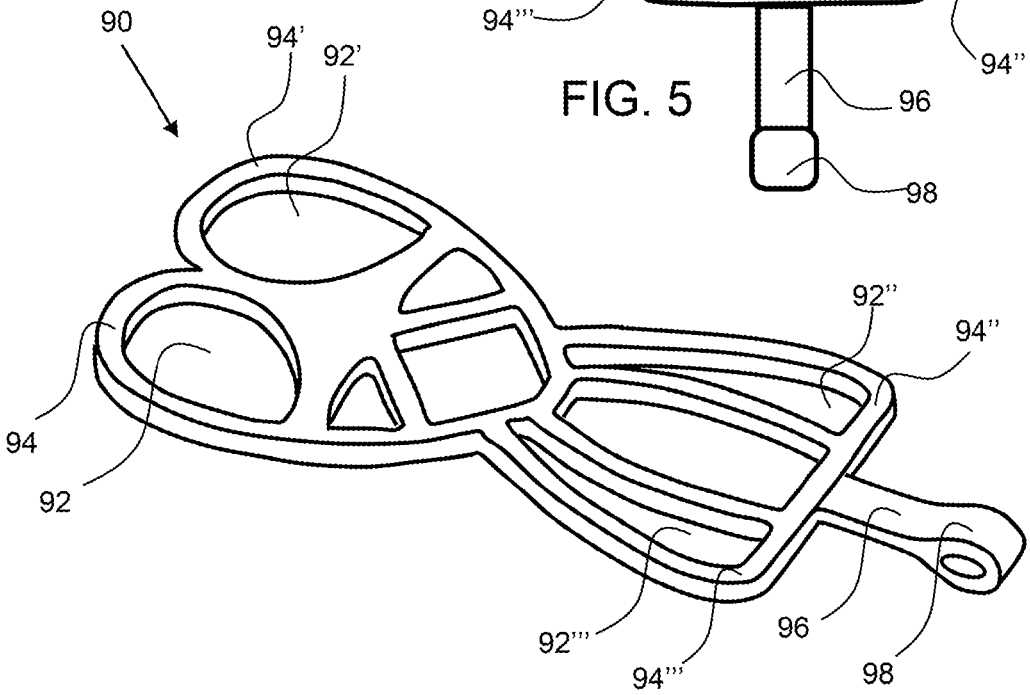

Referring now to FIGS. 5 and 6, an exemplary mobile device attachment 90 has corner extensions 94, 94', 94", 94'" for extending over the corners of a mobile device. The corner extensions are formed by corner apertures 92, 92', 92", 92'" through the mobile attachment device. The mobile attachment device has an attachment tab 96 extending therefrom with an attachment loop 98 on the extended end of the attachment tab. The attachment tab, may be detachably attachable to the mobile device attachment or the two components may be a monolithic part that may be formed by a single piece of material, such as a molded part.

Figure 7:
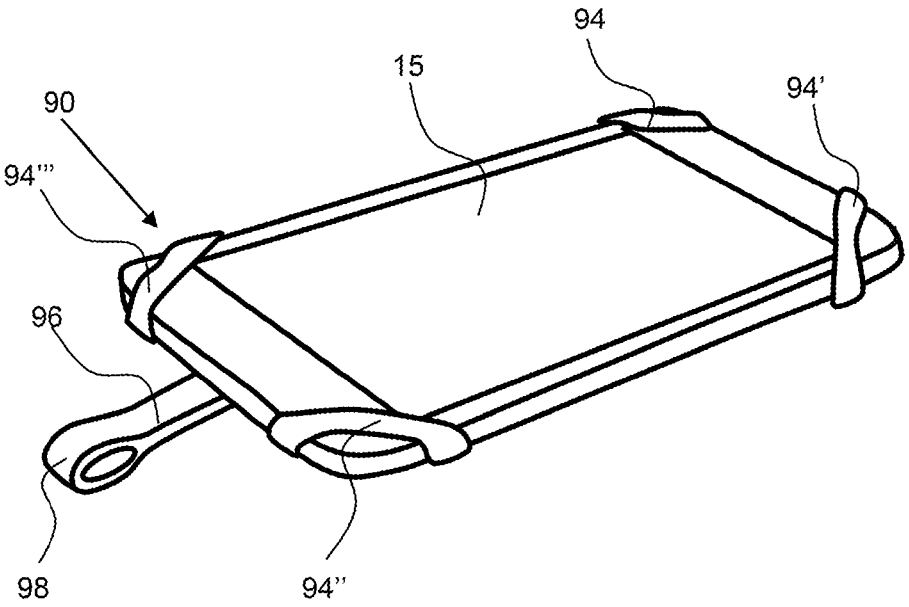
FIG. 7 shows a perspective view of an exemplary mobile device attachment of an extendable coupling system, coupled to a mobile device with the corner extension extending over the corners of the mobile device with the attachment tab extending to an attachment loop.

As shown in FIG. 7, an exemplary mobile attachment 90 is coupled to a mobile device 15, such as a mobile phone, with the corner extension 94, 94', 94", 94'" extending over the corners of the mobile device. The attachment tab 96 extends from the mobile device to receive the retractable coupler.

Figure 8:
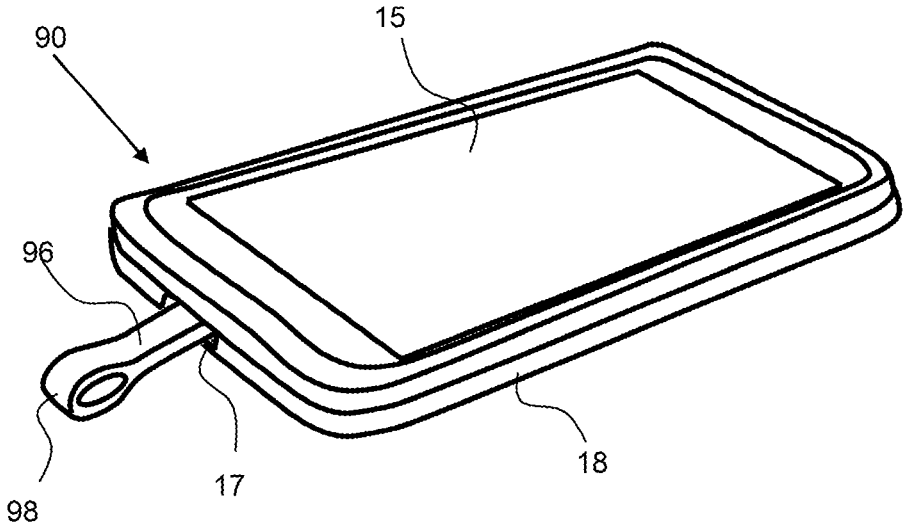
FIG. 8 shows a perspective view of an exemplary mobile device attachment an extendable coupling system, coupled to a mobile device by being retained in the mobile device cover with the attachment tab extended out through an opening in the cover.

As shown in FIG. 8, an exemplary mobile device attachment 90 has is coupled to a mobile device 15 by being retained in the mobile device cover 18 with the attachment tab 96 extended out through an aperture 17 in the cover.

Figure 9:
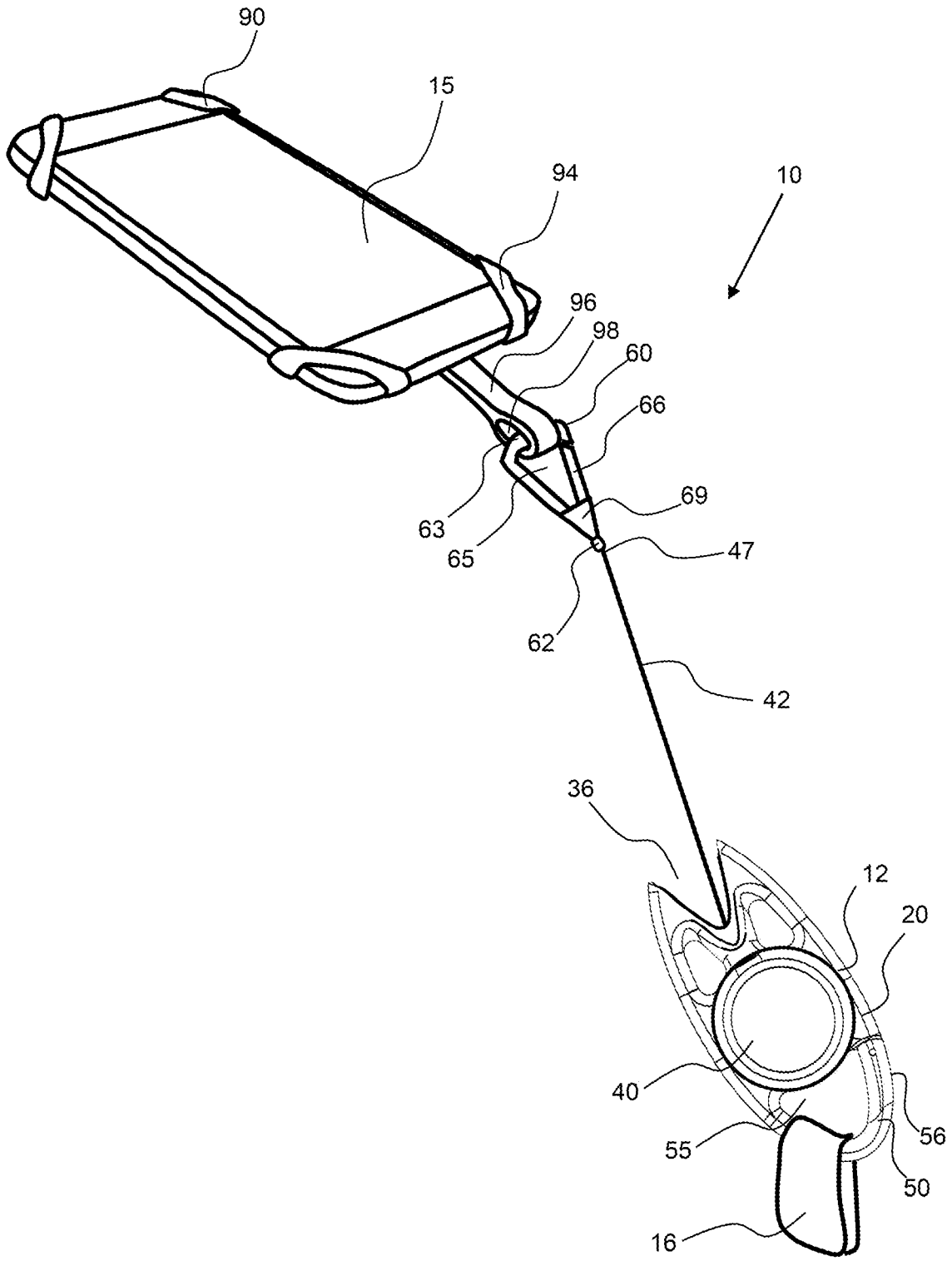
FIG. 9 shows an extendable coupling system comprising a mobile device attachment attached to a mobile phone and the retractable coupler attached to the loop of the attachment tab, and the retractable coupler coupled to the coupler body by the tether and finally, the coupler body attached to a body coupler loop, such as a belt loop.

As shown in FIG. 9, an extendable coupling system 10 comprising a mobile device attachment 90 attached to a mobile device 15, such as a mobile phone and the retractable coupler 60 is attached to the attachment loop 98 at the end of the attachment tab 96. The retractable coupler 60 is coupled to the coupler body 20 by the tether 42 and the dual coupler 12 is attached to a body coupler loop 16, such as a belt loop. The spring loaded tether 40 may provide enough support to avoid a catastrophic fall to the ground of the mobile device whereby the length of the tether will limit how far the mobile device can extend from the coupler body. The spring loaded tether device 40 may produce enough force on the tether 42 to retract the mobile device 15 back to the dual coupler 12.

It will be apparent to those skilled in the art that various modifications, combinations and variations can be made in the present invention without departing from the scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. An extendable coupling system comprising:

a) a dual coupler comprising:

i) a coupler body having a continuous outer perimeter;

ii) a spring-loaded tether device comprising an extendable tether having a length from a retained end to a coupler end;

iii) a body coupler aperture in the coupler body and configured on first end of the coupler body;

iv) a body coupler comprising a body coupler latch extending along a portion of the continuous outer perimeter and configured to pivot into said body coupler aperture to open said body coupler;

v) a retractable coupler that is coupled to the coupler end of the spring-loaded tether, said retractable coupler comprising:

a retractable coupler body having an extended end and a tether end;

a retractable coupler aperture in said retractable coupler body proximal to said extended end;

a retractable coupler latch that is configured to pivot into the retractable coupler aperture to open said retractable coupler;

vi) a receptor recess for receiving the retractable coupler in a stowed configuration;

wherein the retractable coupler forms a portion of the continuous outer perimeter when in said stowed configuration;

wherein the coupler body has thickness between a top surface and a bottom surface of no more than 50 mm;

wherein the continuous outer perimeter extends between said top surface and said bottom surface;

wherein the continuous outer perimeter is a continuous curved surface, having no sharp corners;

wherein the coupler body and retractable coupler form said continuous outer perimeter when the retractable coupler is in said stowed configuration in the receptor recess; and wherein a portion of the retractable coupler is configured between the top and bottom surfaces in the receptor recess when in said stowed configuration.

2. The extendable coupling system of claim 1, further comprising a mobile device attachment.

3. The extendable coupling system of claim 2, wherein the mobile device attachment is a planar elastic attachment that is rectangular in shape having corner apertures proximal to each corner to form corner extensions that are configured for extending around corners of a mobile device.

4. The extendable coupling system of claim 3, wherein the mobile device attachment comprises an attachment tab having an attachment loop configured on an extended end of the attachment tab.

5. The extendable coupling system of claim 4, wherein the mobile device attachment is configured for placement between a mobile device cover and a mobile device with the attachment tab extending out from the mobile device cover through an aperture in the mobile device cover.

6. The extendable coupling system of claim 1, wherein spring-loaded tether comprises a torsional spring configured to retract the extendable tether when said extendable tether is extended from the extendable coupling system.

7. The extendable coupling system of claim 1, wherein the torsional spring produces at least 1 Newton of force to retract the extendable tether.

8. The extendable coupling system of claim 1, wherein the coupler body is planar.

9. The extendable coupling system of claim 8, wherein the coupler body comprises a top surface and a bottom surface that are planar.

10. The extendable coupling system of claim 9, wherein the continuous outer perimeter is smooth when the retractable coupler is stowed in the receptor recess.

11. The extendable coupling system of claim 1, wherein the continuous perimeter consists of curved surfaces.

12. The extendable coupling system of claim 1, wherein the retractable coupler tapers toward the tether end.

13. The extendable coupling system of claim 12, wherein the retractable coupler body is U-shaped around the retractable coupler aperture.

14. The extendable coupling system of claim 12, wherein the retractable coupler is planar having a top surface and a bottom surface that are planar.

15. The extendable coupling system of claim 12, wherein the retractable coupler comprises a centering feature on the tether end that causes the retractable coupler to rotate into a planar alignment with the top and bottom surfaces of the coupler body.

16. The extendable coupling system of claim 15, wherein the centering feature is a portion of the retractable coupler body that tapers toward the tether end.

17. The extendable coupling system of claim 1, wherein the spring-loaded tether device is configured between the body coupler and the retractable coupler.

* * * * *